US005660123A

United States Patent [19]

Tadmor et al.

[11] Patent Number: 5,660,123

[45] Date of Patent: Aug. 26, 1997

[54] METHOD AND INSTALLATION FOR THE DESTRUCTION OF NOXIOUS MATERIALS

[75] Inventors: Oded Tadmor, Ramat-Hasharon; Eitan Hirsch, Netanya, both of Israel

[73] Assignee: Taas-Israel Industries Ltd., Ramat Hasharon, Israel

[21] Appl. No.: 472,007

[22] Filed: Jun. 6, 1995

Related U.S. Application Data

[62] Division of Ser. No. 81,653, Jun. 23, 1993, Pat. No. 5,527, 983.

[51] Int. Cl.[6] ..... F23J 3/00

[52] U.S. Cl. ..... 110/216; 110/237; 588/900; 588/202

[58] Field of Search ..... 110/235, 237, 110/215, 216, 297, 203, 204, 205, 210; 588/900, 202

[56] References Cited

U.S. PATENT DOCUMENTS 5,582,119 12/1996 Barkdoll ..... 110/237 X

*Primary Examiner*—Henry A. Bennett
*Assistant Examiner*—Susanne C. Tinker
*Attorney, Agent, or Firm*—Helfgott & Karas, PC.

[57] ABSTRACT

An installation for the batchwise destruction of noxious materials is described. The noxious material is fed batchwise into a combustion furnace holding a burning coal bed which induces combustion or detonation and also serves as damper for explosion fragments. Burning combustion gases are withdrawn from the upper part of the furnace and conducted while burning to a gas/solid separator. Optionally the burnt out combustion gases are bubbled through water or aqueous solution for the absorption of poisonous gas components and an essentially clean carbon dioxide/air mixture is discharged to the atmosphere.

4 Claims, 2 Drawing Sheets

METHOD AND INSTALLATION FOR THE DESTRUCTION OF NOXIOUS MATERIALS

This is a division of application Ser. No. 08/081,653, filed Jun. 23, 1993, now U.S. Pat. No. 5,527,983.

FIELD OF THE INVENTION

The present invention is in the field of disposal of hazardous materials and substances, e.g. ammunition and explosives that are past their expiry date, expired or waste chemical substances which themselves are hazardous and/or which upon burning produce hazardous decomposition products, and the like.

BACKGROUND OF THE INVENTION

According to the state of the art, hazardous materials and substances of the kind specified are destroyed by open burning or detonation processes, i.e. by open-air combustion processes in the course of which hazardous combustion gases are discharged into the open atmosphere. Such processes can, in the first place, be carried out only at remote locations far away from inhabited areas. Even so, it has been realized that with the increase of the quantities of ammunition, explosives and chemicals that have to be disposed of annually, open-air burning and detonation even at remote places is developing world-wide into a source of hazardous air pollution. In consequence, legislation is developing by which open-air burning and detonation of hazardous materials may no longer be carried out in the open and it is accordingly the object of the present invention to provide environmentally friendly processes and means for the burning and detonation of hazardous materials and substances, or materials and substances which upon combustion yield noxious combustion products. Such materials of which ammunition, explosives and chemicals are typical examples, will be referred to hereinafter collectively as "noxious materials". Furthermore, in the following the term "combustion" is to be understood as relating also to explosions.

SUMMARY OF THE INVENTION

In accordance with the present invention there is provided a method of destroying noxious materials, comprising:

i) providing a pressure resistant combustion furnace holding a bed of coal;

ii) igniting said bed of coal;

iii) feeding into said pressure resistant combustion furnace noxious materials in a batchwise fashion;

iv) allowing combustion to occur within the combustion furnace;

v) withdrawing combustion gases from the combustion furnace, adding air thereto and inducing continuous combustion of said gases outside the furnace to yield fully burnt combustion gases;

vi) subjecting said fully burnt combustion gases to treatment for the removal of solid components and any poisonous gaseous components; and vii) discharging a remaining environmentally friendly gas mixture to the atmosphere.

The nature of the coal used in the performance of the method according to the invention is not critical and any kind of black or brown coal can be used.

The present invention further provides an installation for the destruction of noxious material comprising:

i. a combustion furnace with upper and lower ends;

ii. feeder means at the upper end of the combustion furnace;

iii. combustion gas withdrawal means near the upper end of the combustion furnace;

iv. discharge means at the lower end of the combustion furnace;

v. gas injector means near the lower end of the combustion furnace;

vi. combustion gas processing means comprising pipe means with one end linked to said combustion gas withdrawal means and the other end to trapping means comprising a solid/gas separator; and vii. means for the escape of combustion gas from said trapping means.

For operation, the combustion furnace is charged with coal, say up to one quarter or one third of its height, to produce a coal bed within the furnace. The coal bed is ignited by the injection of a burning gas, say butane gas, through the gas injector means. Once the coal is ignited, air is continuously injected through the gas injector means in a controlled fashion so as to keep the coal bed in the combustion furnace burning or simmering at a desired rate, as may be required.

Once a burning or simmering coal bed has been established within the combustion furnace, the noxious material to be destroyed is fed batchwise through the feeder means of the furnace. Preferably this opening has a seal so designed that, in the course of the feeding of a batch of noxious material, no gases from the furnace escape to the atmosphere. In a preferred embodiment of the invention, such seal is a double bell seal of a kind similar to the one that is being used in iron smelting furnaces.

Where the noxious material is ammunition, the fed-in pieces or batches of ammunition drop onto and sink into the simmering or burning coal bed and explode therein, with the coal bed acting as a shock absorber or damper for the explosion fragments.

The combustion inside the furnace is, as a rule, incomplete and thus the combustion gases withdrawn from the furnace still carry, as a rule, an amount of combustible material. Accordingly, the pipe means of the said combustion gas processing means have to be long enough to enable completion of the combustion. Preferably air injector means are provided in the pipe means to promote further combustion.

In the course of operation, the coal bed is stirred up and consequently the combustion gases discharged from the furnace entrain some coal dust and possibly other solid particles originating from destroyed noxious material. Accordingly, the trapping means comprises a gas/solid separation chamber where any solid material entrapped in the combustion gases is separated. In cases where the combustion gases carry with them poisonous components, the trapping means will further comprise at least one vessel holding an absorber solution capable of absorbing such poisonous components, means being provided for bubbling the combustion gases through such vessel.

In accordance with one preferred embodiment of the invention, the pipe means that connect the combustion gas withdrawal means of the furnace with the trapping means are coiled on the outer side of the furnace in heat exchange relationship, whereby some of the heat of combustion of the gases resulting from combustion in the pipe is returned to the furnace.

In operation, the furnace according to the invention is emptied periodically via the discharge means at the lower end of the furnace. Where the furnace serves for the destruction of ammunition, the discharged mixture contains, in addition to coal, a high proportion of iron and possibly some other metals, and this mixture can be fed as is into a steel smelting furnace. Thus, from an operational point of view, some advantages can be gained, in such cases, by placing the combustion furnace according to the invention in the vicinity of a steel mill or even above a smelting furnace.

DESCRIPTION OF THE DRAWINGS

For better understanding, the invention will now be described, by way of example only, with reference to the annexed drawings in which.

DESCRIPTION OF THE SPECIFIC EMBODIMENTS

Figure 1:
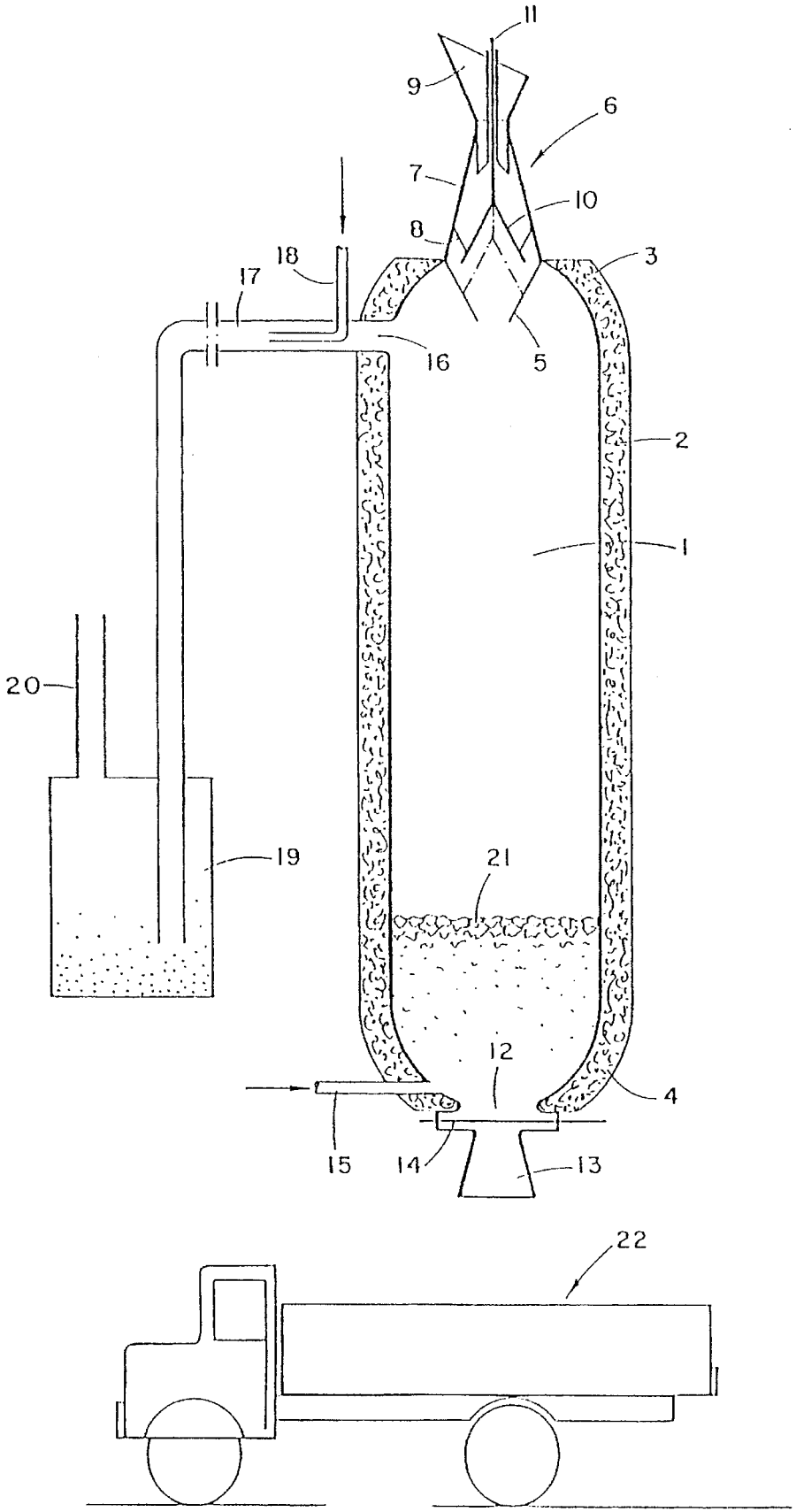
FIG. 1 is a schematic illustration of one embodiment of the invention.

The installation according to the invention shown in FIG. 1 comprises an iron combustion furnace 1 surrounded by a heat insulation layer 2 and having upper and lower ends 3 and 4, respectively. The upper end 3 is fitted with a funnel-shaped feeder port 5 on which is mounted a double bell seal 6 having a frustoconical lower chamber 7 fitted with a hopper 8 and an upper, centrally bored funnel 9 which seals chamber 7 from above. Hopper 8 is associated with a conical seal 10 with an integral shaft 11, vertically reciprocable between an upper position shown in full lines in FIG. 1, in which hopper 8 is sealed while the feeder port 5 is open, and a lower position shown by dashed lines in FIG. 1 in which hopper 8 is open and the feeder port 5 is sealed. If desired, cooling means such as air injection means (not shown) may be provided at the double bell seal 6 for the purpose of preventing early heating and premature detonation of fed-in ammunition and explosives.

The lower end 4 of furnace 1 has a discharge opening 12 fitted with a hopper 13 having a retractable bottom plate 14 which can be shifted at will from the closed position shown in FIG. 1 to an open position at which the contents of furnace 1 is discharged via hopper 13.

The lower end portion 4 of furnace 1 further comprises a gas injector 15 and near the upper end portion 3 there is provided a combustion gas withdrawal opening 16 connected to a pipe 17 fitted with air injector means 18 and leading to trapping means 19 fitted with a chimney 20.

In FIG. 1 furnace 1 is shown to hold a coal bed 21 and the furnace is so mounted that a lorry 22 can drive underneath for receiving matter dumped from the furnace.

In operation, coal is charged into combustion furnace 1 to form therein a coal bed 21 which is ignited via the gas injector means 15, e.g. by injecting a burning butane/air mixture. Once the coal bed 21 has been ignited, only air is injected via injector means 15 and the rate of air injection is controlled so, as to maintain the combustion in coal bed 21 at a desired level.

Once coal bed 21 is burning, batches of material to be destroyed, e.g. ammunition, are sequentially charged into chamber 7 of the double bell seal 6 via the upper funnel 9 and if appropriate the charged material is cooled, e.g. by injected air, in order to avoid premature ignition and detonation. Once a charged batch is received by chamber 7, seal 10 is lowered from the upper position shown in full lines in FIG. 1 into the lowermost position shown by way of dashed lines. In consequence, the hopper 8 is cleared and the batch of ammunition or other material to be destroyed drops from chamber 7 onto the conical wall of feeder port 5 and seal 10 where it is arrested. Once this has been completed, seal 10 is withdrawn to its uppermost position whereupon the material which has been arrested by it becomes free to drop inside the central portion of the simmering or burning coal bed 21 inside furnace 1, penetrating into the interior of the coal bed. In case of ammunition or explosive material, there occurs a detonation while other material is simply burnt. Any shell fragments resulting from the detonation of ammunition are dampen inside coal bed 21.

An operational cycle comprises feeding one batch into the double bell seal 6, allowing it to drop into the simmering or burning coal bed 21, and allowing combustion of the fed-in material to occur. When such a cycle is completed, the next batch is fed in and a similar new cycle begins.

During the entire operation, combustion gases are withdrawn via opening 16 into exhaust pipe 17 where they are mixed with fresh air injected via injector 18 and a burning mixture of air and combustion gases from furnace 1 is conducted along pipe 17 into the trapping means 19. The length of pipe 17 is so calculated that by the time the gases reach trapping means 19, the combustion is complete.

The trapping means 19 here shown comprise only a gas/solid separation chamber in which any entrapped solids are allowed to sink and an environmentally friendly gas, being essentially a $CO_2$/air mixture, escapes through chimney 20. However, where it is to be expected that the combustion gases include non-combustible noxious gaseous components, trapping means 19 will, in addition to the solid/gas separation chamber, also include at least one vessel holding an absorber solution through which the combustion gases are bubbled for the absorption of noxious components.

If necessary, make-up coal may periodically be fed into furnace 1 via the double bell seal 6.

Where the furnace serves for the destruction of waste ammunition, the metal fragments of the exploded ammunition sink to the bottom of the furnace and coal bed 21 is gradually lifted.

The waste accumulating inside combustion furnace 1 is periodically discharged via the discharge opening 12 and hopper 13 by retracting the bottom plate 14 thereof. The dumped off material may be received by a suitable vehicle such as lorry 22, a railway wagon and the like, or alternatively by a conveyor. Where ammunition has been destroyed and the discharged material accordingly consists of a coal/metal mixture, such mixture may be conducted as is to a smelting furnace.

If desired, combustion furnace 1 may be mounted above a smelting furnace so that the feeder port of the latter and hopper 13 of combustion furnace 1 are aligned. In such an arrangement each batch of waste material released from combustion furnace 1 is dumped directly in the smelting furnace.

It should be noted that in the course of an operation according to the invention any metal components are not melted. Consequently, the temperature prevailing within furnace 1 can be kept relatively low so as to be sustainable by the metal such as iron or steel of which the furnace is made, and there is no need for any ceramic lining on the inner metallic surface thereof which, if it were required, would be subjected to constant wear and tear to the extent where the entire operation might become impractical.

The dimensions of the combustion furnace 1 and the strength of the wall thereof will have to be adapted to the nature of the material to be destroyed. Thus, for example, where the furnace serves for the destruction of relatively heavy shells weighing, say, 5 kg. each, the furnace will be made of steel with wails about 2.6 cm thick, and be relatively large, say 10 meters high, 2 meters in diameter. If, on the other hand, the furnace serves for the destruction of firearm ammunition, explosive or non-explosive chemicals, the dimensions will be different and possibly metals other that steel may be used. Adaptation of the dimensions and strength of the furnace to the individual case, can be readily done on the basis of general common knowledge and some rudimentary experimentation.

Figure 2:
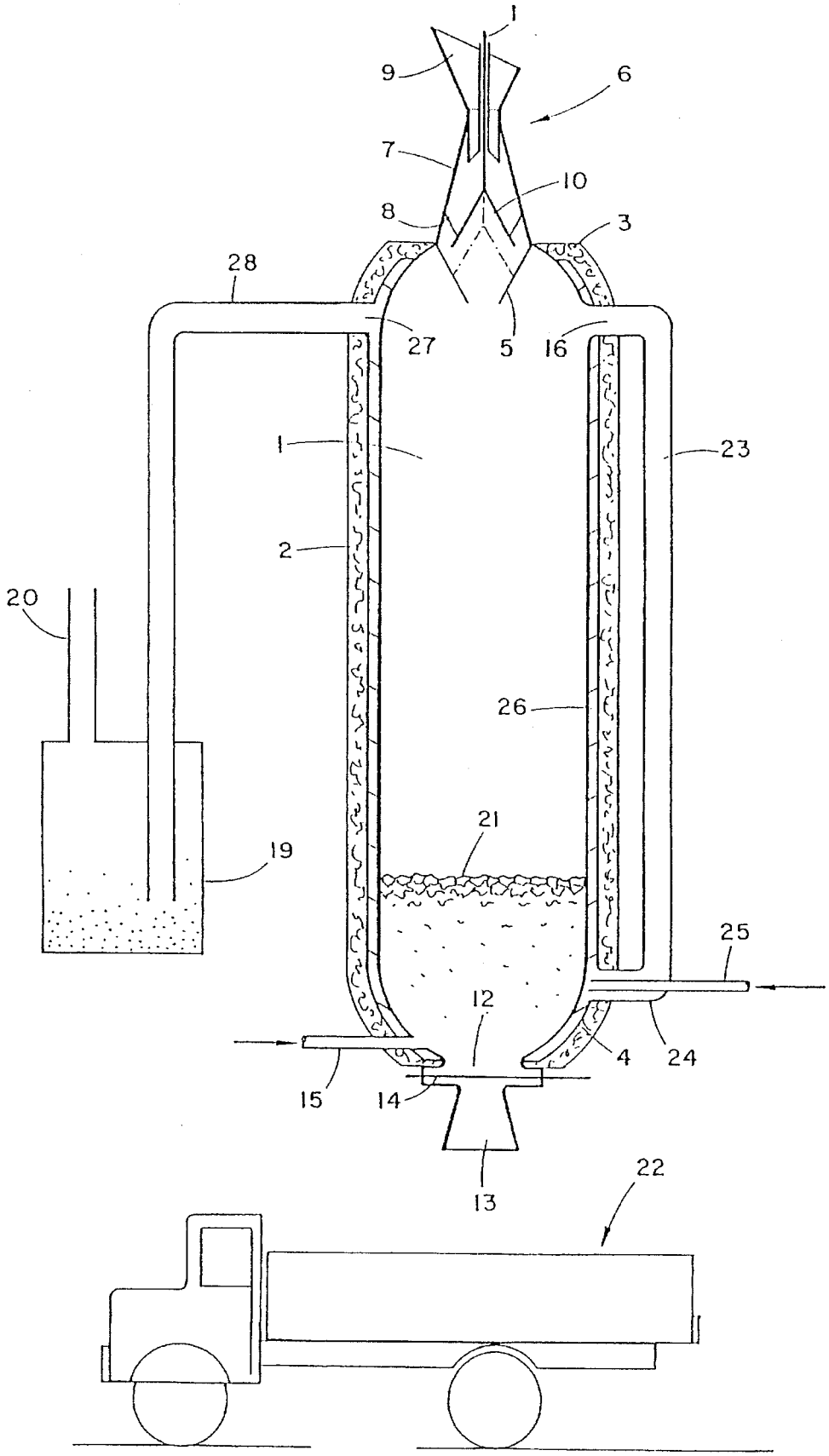
FIG. 2 is a schematic illustration of another embodiment.

The embodiment shown in FIG. 2 is essentially similar to that of FIG. 1 and similar parts are designated by the same numerals. In this embodiment the exhaust pipe 17 of FIG. 1 is replaced by a first exhaust pipe section 23 which at 24 is fitted with an air injector 25 and merges into a serpentine 26 coiled on the outer side of combustion furnace 1 between the body thereof and the insulation layer 2. Serpentine 26 merges at 27 into a second exhaust pipe section 28 which leads into the trapping means 19.

During operation, the combustion gases withdrawn at 16 are fed at 24 together with air injected at 25 into the serpentine 26 from where the fully burnt combustion gases are discharged at 27 into the tail portion 28 of the exhaust pipe which leads into the trapping means 19.

As a practical example, using an installation of the kind shown in FIG. 2 with a steel combustion furnace having 2.5 cm thick walls and measuring 10 m in height and 2 m in diameter, ammunition shells weighing 5 kg each are destroyed batchwise, the duration of the phases of an operational cycle being as follows:

| | |
|---|---|
| Drop of a shell from double seal 6 into coal bed 21 | 1 sec |
| Heating up until explosion | 5–10 sec |
| Pressure release by combustion and withdrawal via discharge opening | 2–3 sec |
| Resettling of stirred up coal | 1–2 sec |
| Charging of a new shell into seal 6 | 1 sec. |

We claim:

1. An installation for the batchwise destruction of noxious material comprising:

i) a pressure-resistant combustion furnace with upper and lower ends, said furnace having a bed of coal therein;

ii) feeder means at the upper end of the combustion furnace for feeding batches of noxious material for combustion;

iii) combustion gas withdrawal means ear the upper end of the combustion furnace for withdrawing combustion gases and for providing continuous combustion of said gases;

iv) discharge means at the lower end of the combustion furnace for the periodic discharge of noncombustible waste accumulating inside the furnace;

v) gas injector means near the lower end of the combustion furnace for providing combustion of said bed of coal;

vi) combustion gas processing means comprising pipe means with one end linked to said combustion gas withdrawal means and the other end to trapping means comprising a solid/gas separator; and vii) means for the escape of combustion gas from said trapping means;

whereby said combustion gases withdrawn through said combustion gas withdrawal means are fully burnt and the fully burnt gases are freed of any poisonous gaseous components prior to being discharged to the atmosphere.

2. An installation according to claim 1, comprising means for the injection of air into the pipe means of said combustion gas processing means.

3. An installation according to claim 1, wherein the pipe means of said combustion gas processing means are at least partly coiled on the outer side of the furnace.

4. An installation according to claim 1, wherein said feeder means are sealed by means of a double bell type seal.

* * * * *

UNITED STATES PATENT AND TRADEMARK OFFICE

CERTIFICATE OF CORRECTION

PATENT NO. : 5,660,123

DATED : August 26, 1997

INVENTOR(S) : Oded Tadmor and Eitan Hirsch

It is certified that error appears in the above-indentified patent and that said Letters Patent is hereby corrected as shown below:

On the title page:

[73] Assignee: Israel Military Industries Ltd., Ramat Hasharon, Israel

Signed and Sealed this

Seventh Day of April, 1998

Bruce Lehman

*Attest:*

BRUCE LEHMAN

*Attesting Officer*

*Commissioner of Patents and Trademarks*